United States Patent [19]

Baum

[11] 4,270,803

[45] Jun. 2, 1981

[54] CUTTER DRUM DRIVE ASSEMBLY FOR CANTED END SECTIONS

[75] Inventor: Gerald L. Baum, Belleville, Ill.

[73] Assignee: National Mine Service Company, Pittsburgh, Pa.

[21] Appl. No.: 77,323

[22] Filed: Sep. 20, 1979

[51] Int. Cl.[3] ..... E21C 27/24

[52] U.S. Cl. ..... 299/76; 299/89

[58] Field of Search ..... 299/75, 76, 78, 89

[56] References Cited

U.S. PATENT DOCUMENTS

| | | | |
|---|---|---|---|
| 3,141,703 | 7/1964 | Gonski | 299/75 X |
| 3,305,273 | 2/1967 | Kilbourne | 299/78 |
| 3,774,969 | 12/1971 | LeBegue | 299/76 |
| 3,848,930 | 10/1973 | LeBegue | 299/76 |
| 3,966,257 | 6/1976 | Shah | 299/76 |

*Primary Examiner*—Ernest R. Purser

*Attorney, Agent, or Firm*—Stanley J. Price, Jr.; John M. Adams

[57] ABSTRACT

A continuous mining machine includes a body portion having a longitudinal axis and mounted on endless tracks. A boom member extends forwardly from the body portion with a cutter drum member rotatably mounted on the front of the boom member. The cutter drum member has an intermediate drum section and a pair of canted end drum section. The intermediate drum section is spaced from the end drum sections to provide openings therebetween. The boom member has front end portions extending through the openings to rotatably support the cutter drum member. Input drive shafts extend from drive motors on the body portion forwardly from the boom member at an acute angle with respect to the longitudinal axis of the body portion through the openings. In each end drum section meshing spiral bevel gears connect the input drive shaft through a planetary gear train to the end drum drive shaft. Rotation is transmitted from each end drum drive shaft to a drive shaft for rotating the intermediate drum section. Positioning the input drive shafts at an angle with respect to the longitudinal axis of the machine body portion facilitates positioning planetary gear trains in the end drum section to locate the cutter drum assembly for efficient feeding of dislodged material onto the machine and reduce the diameter of the intermediate drum section.

22 Claims, 4 Drawing Figures

CUTTER DRUM DRIVE ASSEMBLY FOR CANTED END SECTIONS

BACKGROUND OF THE INVENTION

1. Field of the Invention

This invention relates to a continuous mining machine and more particularly a mining machine having a cutter drum drive assembly that includes input drive shafts canted at a preselected angle with respect to the longitudinal axis of the mining machine for positioning the cutter drum at a location forward of the gathering platform to facilitate efficient feeding of dislodged material on to the gathering platform.

2. Description of the Prior Art

Continuous mining machines, as illustrated in U.S. Pat. No. 3,774,969, are utilized in underground mining operations to continuously dislodge solid material from the face of a mine shaft. A boom member extends forwardly from an elongated body portion of the mining machine that is propelled through the mine on endless crawler tracks. The boom member is pivotally connected to the mining machine body portion and rotatably supports a cutter drum assembly having peripherally extending elements. The cutter drum assembly extends transversely to the longitudinal axis of the body portion and upon rotation, the cutting elements dislodge solid material from the mine face.

The cutter drum assembly is pivoted through an arcuate vertical path and sumped into the mine face to make a shear cut in the mine face. The dislodged material is fed rearwardly onto a gathering platform having suitable gathering devices which direct the dislodged material rearwardly onto a conveyor that extends longitudinally on the mining machine to transport the material toward the rear of the mining machine. By dislodging mineral material from the mine face in this manner a mine passageway or room is formed to thus permit the mining machine to advance and continuously dislodge material from the mine face.

Full face drum-type mining machines of the type illustrated in U.S. Pat. No. 3,305,273 are known to include support means and drive means for the drum. The support and drive means include fixed annular end portions of the boom member extending around the external surface of the drum. Endless chain elements with cutter bits mounted thereon extend around the support means to dislodge material from the mine face along the width of the annular end portions of the supporting boom.

In U.S. Pat. No. 3,774,969, as discussed above, the drum member has an intermediate drum section and canted end drum sections with rear openings between the inner ends of the end drum sections and the outer ends of the intermediate drum section. Input shafts extend through these openings and have drive pinions meshing with bevel gears rotatably supported within the intermediate drum section. The bevel gears are splined to shafts with sun gears of planetary gear trains nonrotatably mounted thereon. Planet gears of each planetary gear train are secured to the intermediate drum section and are rotated by the driven sun gear. The planet gears are also connected through universal joints to the adjacent canted end drum sections.

The above described arrangement of transferring rotation from the intermediate drum section through a planetary gear train to the respective end drum section requires a relatively large diameter intermediate drum section in order to accommodate the planetary gearing. However, a large diameter intermediate drum section has certain disadvantages in mining operations where the seam to be mined is relatively thin. Thus in this context the diameter of the cutter drum assembly and particularly the diameter of the intermediate drum section and the size of the drive gearing are limited by the mineral seam thickness. For this reason a drum drive arrangement with a planetary gear train in the intermediate drum section is not desirable for thin seam mining operations.

As further illustrated in U.S. Pat. No. 3,774,969, as well as in U.S. Pat. No. 3,848,930, a planetary gear train in the intermediate drum section transmits rotation to the canted end drum sections. The canted end drum sections extend outwardly at an angle with respect to the intermediate drum section so that the end drum drive shafts are not axially aligned with the intermediate drum drive shafts. The input drive shafts extend from the drive motors in parallel relation to the longitudinal axis of the mining machine. Because the end drum sections are canted outwardly, consequently the end drum drive shafts are positioned at an angle greater than 90° with respect to the input drive shafts.

As above discussed it is preferably to position a planetary gear train in each end drum section rather than in the intermediate drum section. With this arrangement rotation is transmitted from the end drum sections to the intermediate drum section rather than from the intermediate section to the end drum sections. By positioning the planetary gear train in the respective end drum sections the base diameter of the intermediate drum section can be reduced to provide a more efficient dislodging operation, particularly in thin mineral seams. One advantage is the increased clearance provided around the intermediate drum section for the flow of dislodged material from the mine face onto the gathering platform. A smaller base diameter for the intermediate drum section would substantially prevent clogging of dislodged material between the mine face and the intermediate drum section because of the increased clearance made available between the mine face and the intermediate drum section.

For a mining machine having canted end drums, however, the end drum drive shafts are positioned at an angle greater than 90° with respect to the input drive shafts. This arrangement provides insufficient area within the end drum sections for positioning a planetary gear train. There is need for a continuous mining machine having a cutter drum drive assembly which includes a planetary gear train in the end drum sections to permit a reduction in the base diameter of the intermediate drum section and thereby improve the overall efficiency of the cutter drum assembly to dislodge material from a mine face.

While it has been suggested to provide a cutter drum drive for transmitting rotation from the end drum sections to the intermediate drum section in which the drum sections are longitudinally aligned the prior art devices do not provide such a drive for a cutter drum having canted end drum sections. The prior art devices position the drive gearing in the intermediate drum section requiring the base diameter thereof to be enlarged. Thus a drive arrangement featuring planetary gear trains in the canted end drum sections would permit the use of an intermediate drum section of reduced diameter for thin seam mining operations.

SUMMARY OF THE INVENTION

In accordance with the present invention there is provided a continuous mining machine that includes a body portion having a longitudinal axis. Propelling means supports the body portion for advancing the body portion. A boom member is pivotally secured to the body portion and extends forwardly therefrom. A drum member is rotatably mounted on the front of the boom member transversely to the body portion. The drum member has cutting elements extending therefrom. The cutting elements are arranged on the drum member to provide a continuous cutting pattern along the length of the drum member. The drum member has an intermediate drum section and a pair of end drum sections. The pair of end drum sections extend angularly from the ends of the intermediate drum sections respectively. The pair of end drum sections are spaced from the intermediate drum section to form a pair of openings between the intermediate drum section and the respective end drum sections. Power means is mounted on the body portion for rotating the drum member. Drive means is provided for transmitting rotation from the power means to the drum member. The drive means includes input drive shaft means for transmitting rotation to the end drum sections. The input drive shaft means extends from the power means angularly relative to the body portion longitudinal axis through said pair of openings. Output drive means drivingly connected to the input drive shaft means transmits rotation from the end drum sections to the intermediate drum section.

The input drive shaft means includes a pair of input shafts drivingly connected at their adjacent end portions by meshing helical gears nonrotatably connected to one end of each input shaft. The connected input shafts are positioned parallel to one another and angled with respect to the machine longitudinal axis. A spiral bevel gear is nonrotatably connected to the end of the input shaft positioned within the drum member, and is drivingly connected to a spiral bevel gear of the output drive means. The output drive means also includes a planetary gear train rotatably supported in each end drum section and an end drum drive shaft drivingly connected to the respective end drum section. Rotation of the spiral bevel gear is transmitted by the planetary gear train to the end drum drive shaft. The end drum drive shaft is drivingly connected through a universal joint to an intermediate drum drive shaft. The intermediate drum drive shaft is nonrotatably connected to the intermediate drum section. Thus rotation is transmitted from the planetary gear train in each end drum section by the end drum drive shaft to the intermediate drum drive shaft to rotate the intermediate drum section.

A material gathering platform extends forwardly from the mining machine body portion and is positioned rearwardly of the drum member. A conveyor mechanism extends rearwardly from the gathering platform on the mining machine body for conveying dislodged material rearwardly from the front of the mining machine. Gathering devices on the gathering platform feed dislodged material from the gathering platform onto the conveyor mechanism. The input shafts extend at an acute angle relative to the longitudinal axis of the mining machine to permit positioning of the end drum and intermediate drum drive shafts in an advantageous position outwardly beyond the gathering platform. This arrangement positions the drum member relative to the gathering platform for improved feeding of dislodged material onto the gathering platform.

Accordingly, the principal object of the present invention is to provide for a continuous mining machine a drive assembly that transmits rotation to the drive shafts of the drum member so that the drum member is rotatably positioned relative to the gathering platform for efficiently feeding dislodged material on to the gathering platform.

Another object of the present invention is to provide a drum drive assembly for a continuous mining machine in which the input drive shaft to the drum member is angled with respect to the longitudinal axis of the mining machine.

A further object of the present invention is to provide a mining machine cutter drum drive assembly having a planetary gear train in each canted end drum member for transmitting rotation of the cutter drum motors from the canted end drum members to the intermediate drum member.

An additional object of the present invention is to provide a continuous mining machine having a cutter drum assembly that includes an intermediate drum member between a pair of canted end drum members in which the respective drum members are operable to dislodge material from thin seams.

These and other objects of the present invention will be more completely described and disclosed in the following specification, the accompanying drawings, and the appended claims.

DESCRIPTION OF THE PREFERRED EMBODIMENT

Figure 1:
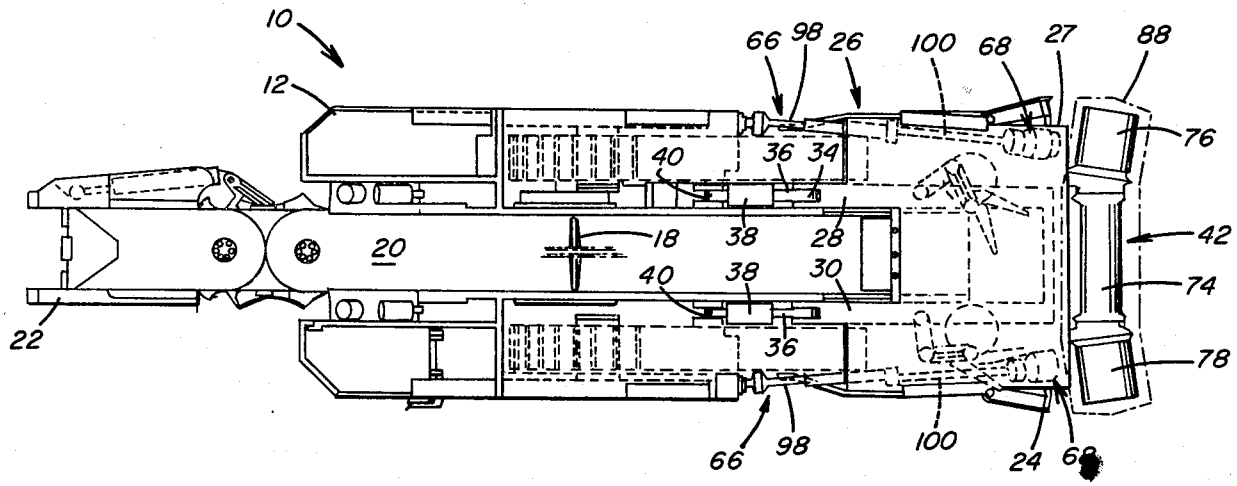
FIG. 1 is a top plan view of the continuous mining machine of the present invention, illustrating the cutter drum member with the canted end portions.
Figure 2:
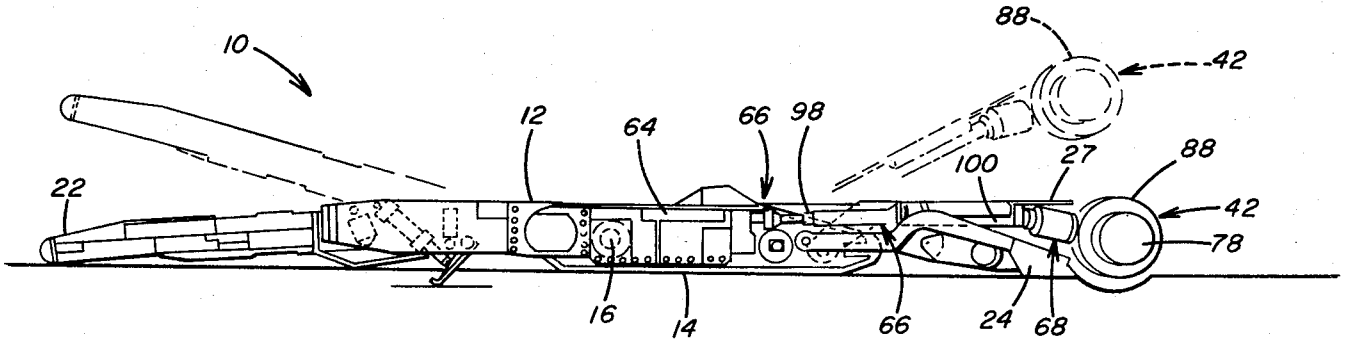
FIG. 2 is a view in side elevation of the continuous mining machine shown in FIG. 1, illustrating the vertical pivotal range of the cutter drum member.

Referring to the drawings and particularly to FIGS. 1 and 2 there is illustrated a continuous mining machine generally designated by the numeral 10 that has a body or frame portion 12 suitably mounted on endless crawler tracks 14. Hydraulic motors 16 are provided to propel the mining machine 10 on the endless crawler tracks 14 to advance the mining machine during the mining operation. An endless conveyor mechanism 18 is positioned in a longitudinal trough member 20 and conveys dislodged material therein from the front of the mining machine to an articulated rear discharge section 22. As illustrated in FIG. 2, a gathering device 24 extends forwardly from the body portion 12 and is arranged to gather and feed the dislodged material onto the conveyor trough 20 so that the dislodged material can be conveyed rearwardly by the endless conveyor mechanism 18 to the discharge section 22.

Figure 3:
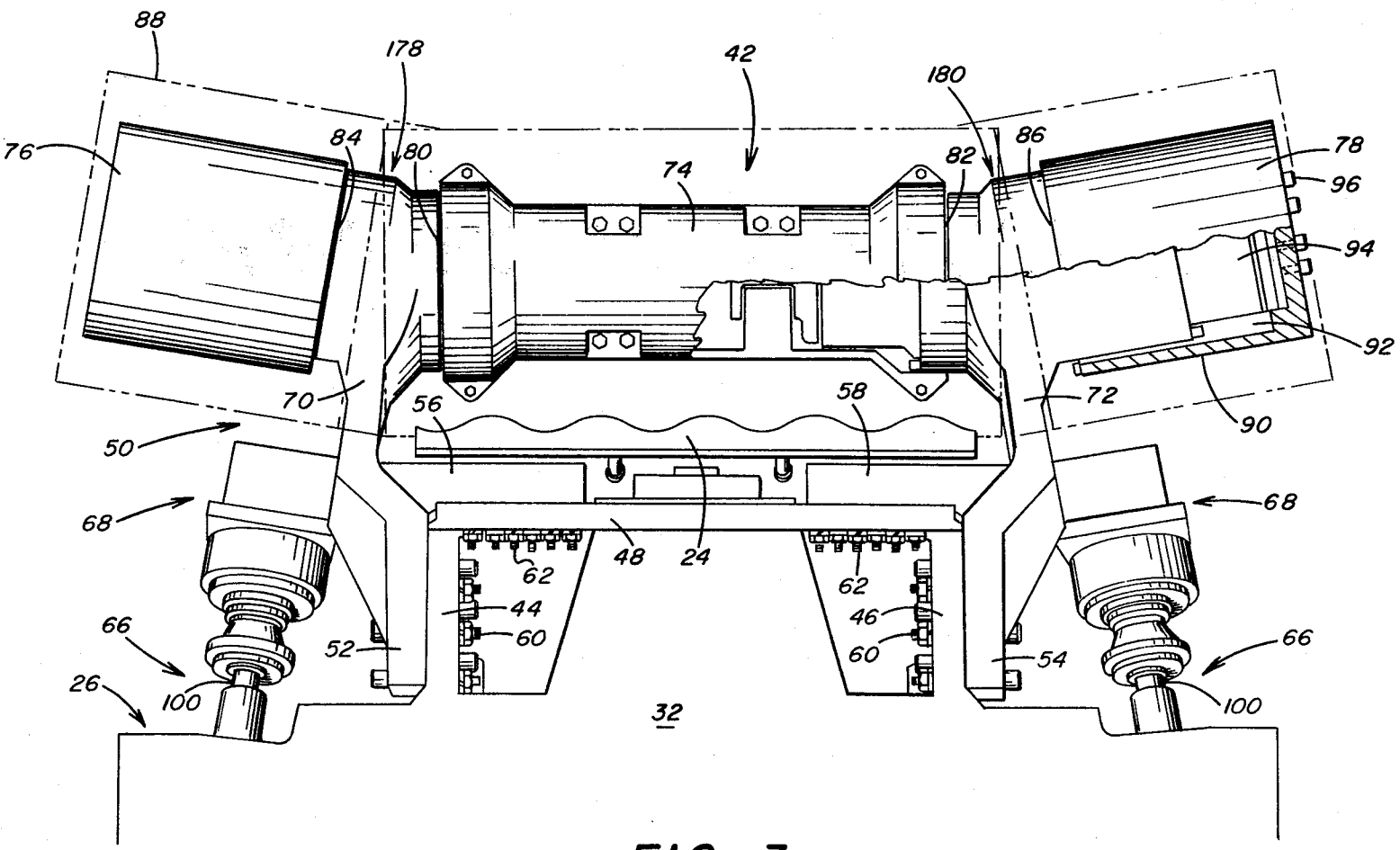
FIG. 3 is an enlarged fragmentary plan view of the cutter drum assembly connected to an extending forwardly of a boom member.

As illustrated in FIGS. 1 and 2, and in greater detail in FIG. 3, a boom member generally designated by the numeral 26 extends forwardly from the body portion 12 and as shown in FIGS. 1 and 2 includes a cover plate 27 that extends from the receiving end portion of the conveyor mechanism 18 forwardly therefrom into overlying relation with the front edge of the gathering device 24. As shown in FIG. 1 the boom member 26 includes a pair of parallel rearwardly extending arm members 28 and 30 that are connected at their forward end portions to a housing 32 that extends transversely across the front of the mining machine 10.

Each of the arm members 28 and 30 are pivotally connected at a pivot point 34 to a piston rod 36 of a piston cylinder assembly 38. The pair of piston cylinder assemblies 38 illustrated in FIG. 1 are, in turn, pivotally connected to the mining machine body portion 12 at pivot points 40. With this arrangement the boom arm members 28 and 30 are pivotally connected to the mining machine body portion 12.

Upon extension and retraction of the piston rods 36 and within the piston cylinder assemblies 38, the boom member 26 is operable to pivot about the pivot points 34 of the arm members 28 and 30 to move the boom member 26 vertically to the position illustrated in phantom in FIG. 2. A cutter drum assembly generally designated by the numeral 42 connected to the boom member 26 performs an upward shear cut of the mine face. Also the mining machine 12 is operable to advance into the mine face with the boom member 26 in the upper position, as illustrated in phantom in FIG. 2. The piston cylinder assemblies 38 operable to pivot the boom member 26 downwardly to the position as illustrated by the solid lines in FIG. 2. In this manner the cutter drum assembly 42 dislodges material from the mine face by a downward shear cut.

The boom member 26 has a second pair of arm members 44 and 46 that extend forwardly from the boom housing 32, as illustrated in FIG. 3. The forward end portions of the arm members 44 and 46 are connected to one another by a transverse support member 48. The cutter drum assembly 42 is supported by a drum housing generally designated by the numeral 50. The drum housing 50 includes a pair of rearwardly extending arm members 52 and 54 which are positioned outboard and abutting the boom arm members 44 and 46 respectively.

The drum housing 50 also includes a pair of laterally extending arm members 56 and 58 that are positioned forwardly of an in abutting relation with the boom member transverse support member 48. The drum housing arm members 52 and 54 are connected to the boom arm members 44 and 46 by a plurality of suitable fastening devices 60. Similarly, the drum housing laterally extending arm members 56 and 58 are connected by a plurality of fastening devices 62 to the transverse support member 48. With this arrangement the cutter drum assembly 42 is connected to the boom member 26.

A pair of cutter drum motors 64, one of which is illustrated in FIG. 2, are mounted on the body portion 12 and are operable to rotate the cutter drum assembly 42, to be described later in greater detail. As illustrated in FIGS. 1 and 3, a drive shaft assembly generally designated by the numeral 66 that is drivingly connected to each of the motors 64 and extends forwardly therefrom to a clutch mechanism generally designated by the numeral 68. The clutch mechanisms 68 are mounted on the drum housing 50. The clutch mechanisms 68 connect the motors 64 to the drive gearing for the cutter drum assembly 42.

The drum housing 50 includes nonrotatable angular housing portions 70 and 72 which extend forwardly from the drum housing arm members 52 and 54. The rotatable portions of the cutter drum assembly 42 are mounted on the nonrotatable annular housing portions 70 and 72. The drive means for the cutter drum assembly 42 extend through the annular housing portions 70 and 72 and are connected to gearing within the cutter drum assembly 42 to rotate the cutter drum assembly 42 to dislodge material from the mine face.

The cutter drum assembly 42 has an intermediate drum section 74 and a pair of end drum sections 76 and 78. The intermediate drum section 74 is rotatably supported by the annular housing portions 70 and 72. The end drum section 76, illustrated in FIGS. 1 and 3, is canted with respect to the intermediate drum section 74 and is rotatably supported by the annular housing portion 70. Likewise the end drum section 78 is canted with respect to the intermediate drum section 74 and is rotatably supported by the annular housing portion 72.

The intermediate drum section 74 has outer annular edge portions 80 and 82, and the end drum sections 76 and 78 have inner annular edge portions 84 and 86. The intermediate drum section 74 and the end drum sections 76 and 78 include a plurality of cutting elements that extend peripherally from the respective drum sections. The end drum sections 76 and 78 are positioned so that the bit pattern formed by the row of cutting elements along the inner annular edge portions 84 and 86 overlap the bit pattern of the row of cutter elements along the intermediate drum section outer annular edge portions 80 and 82 along the front of the cutter drum assembly 42. The bit pattern of the respective drum sections divert rearwardly and outwardly along the rear of the cutter drum assembly 42 so at this point the cutting elements of the intermediate drum section 74 are spaced from the cutting elements of the end drum sections 76 and 78.

This arrangement is illustrated in FIGS. 1 and 3 where the individual cutting elements have been eliminated from the respective drum sections for purposes of illustration. The bit pattern formed by the cutting elements is indicated by the -- line 88. Thus with the above arrangement the cutter drum assembly 42 is operable to dislodge a continuous kerf of material from the mine face without leaving unmined portions in the face. As the cutter drum assembly 42 completes a shear cut in the mine face a relatively horizontal roof and floor are formed in the mine passageway.

Each of the end drum sections 76 and 78 has an identical configuration; therefore, the structure of the end drum section 78 will only be described. As illustrated in FIG. 3, the drum member end section 78 has a cup-shaped body portion 90 having the inner annular edge portion 86 and an opening 92. An end drum drive shaft 94 is rotatably supported on bearings (not shown) within the end drum body portion 90. The end drum drive shaft 94 is suitably connected by drive gearing extending through the annular housing portion 72 to the clutch mechanism 68 and the drive shaft assembly 66. The end drum drive shaft 94 is connected to the body portion 90 by suitable fastening devices 96 to transmit rotation to the body portion 90.

As illustrated in FIGS. 1 and 2, the pair of drive shaft assemblies 66 transmits rotation from the pair of drum rotating motors 64 to the drive gearing of the cutter drum assembly 42. Each of the drive shaft assemblies 66 includes a first drive shaft 98 which is drivingly connected to the respective drive motor 64 and a second drive shaft which is drivingly connected to the first drive shaft 98. The second drive shaft 100 is drivingly connected through the clutch mechanism generally designated by the numeral 68 in FIG. 4 to an input drive shaft 102 for transmitting rotation to each end drum sections 76 and 78. Rotation of drum sections 76 and 78 is transmitted by a planetary gear train generally designated by the numeral 104 in FIG. 4 to the intermediate drum section 74. It should be understood that the drive gearing for the other end drum section 76 to the intermediate drum section 74 is similar to that illustrated in FIG. 4. Thus the description will be confined to the drive means for the drum intermediate section 74 and the end drum section 78.

Figure 4:
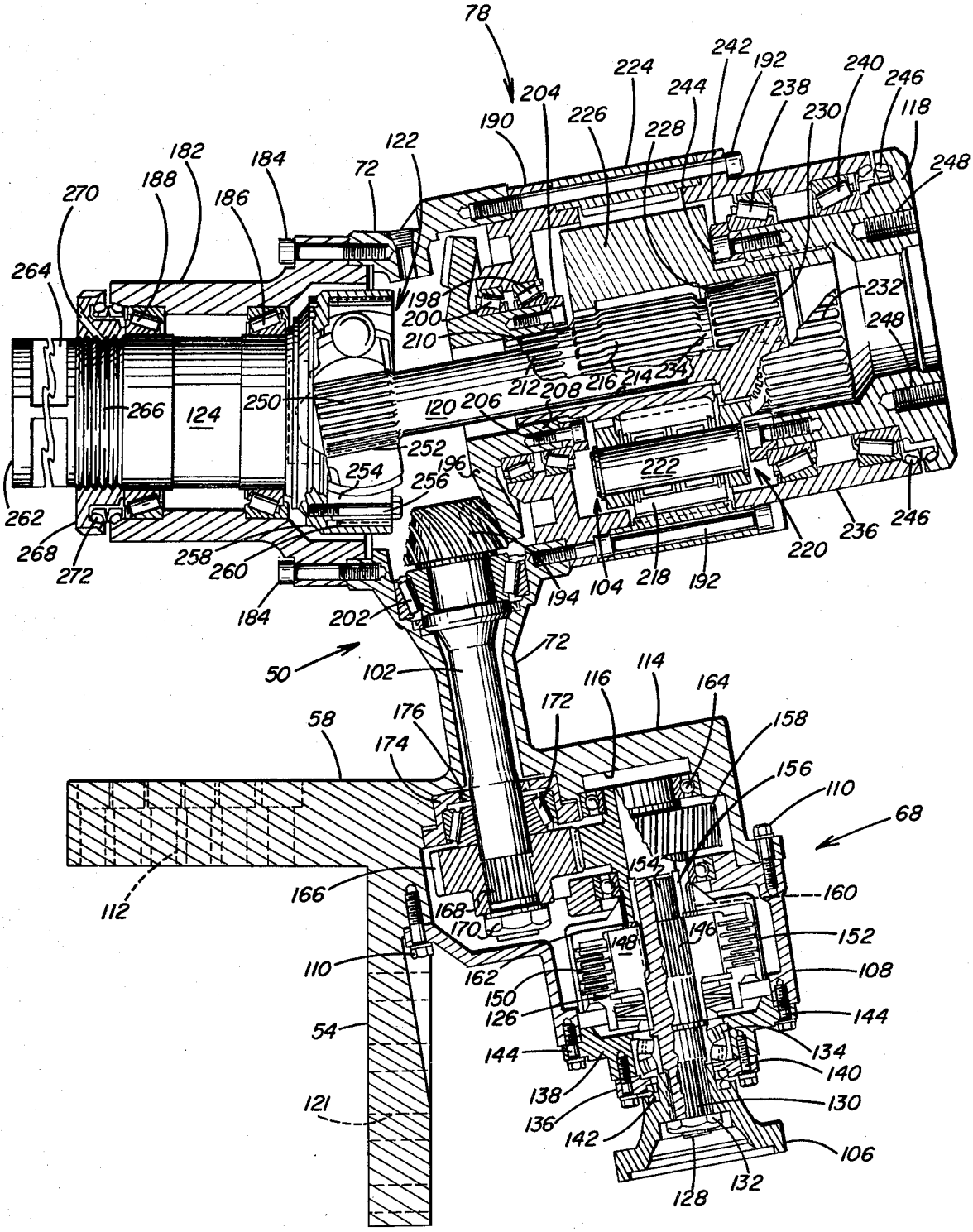
FIG. 4 is a view in section of the drive connection to one of the canted end drums for transmitting rotation to the respective end drum and therefrom to the intermediate drum.

As illustrated in FIG. 4 the clutch mechanism 68 includes an adapter 106 which is arranged to be drivingly connected to the outer end of the second drive shaft 100 of the drive shaft assembly 66. For clarity of illustration the connection of the second drive shaft 100 to the adapter 106 is not shown. The clutch mechanism 68 includes a clutch housing 108 that is connected by bolts 110 of the housing generally designated by the numeral 50 in FIG. 4. As above described the housing 50 includes arm members 54 and 58 having bolt holes 112 to facilitate bolting of the housing 50 to the arm member 46 and transverse support member 48 of the boom member 26, as illustrated in FIG. 3.

The housing 50 includes a gear case portion 114 having a cup shaped recess 116 adapted to receive the clutch mechanism 68. The gear case portion 114 is formed integral with the annular housing portion 72 on which the intermediate drum section 74 and the end drum section 78 are rotatably mounted. The input drive shaft 102 extends through the housing portion 72 and is connected to the planetary gear train 104 within the end drum section 78 for rotating the end drum section 78 to dislodge material from the mine face. The planetary gear train 104 is drivingly connected to an end drum drive shaft 118. End drum drive shaft 118 is connected through universal drive shaft 120 and a universal joint assembly generally designated by the numeral 122 to an intermediate drum drive shaft 124. This drive arrangement will be described later in greater detail.

Now referring to the details of the clutch mechanism 68, a clutch assembly generally designated by the numeral 126 includes a clutch shaft 128 having a splined end portion 130 that meshes with the internally splined portion of the adapter 106. A hex nut 132 retains the adapter 106 on the clutch shaft splined end portion 130. The clutch shaft 128 is rotatably supported within the clutch housing 108 by a bearing 134. The bearing 134 is maintained in surrounding relation with the clutch shaft 128 by a bearing retainer 136 and a bearing carrier 138. The bearing retainer 136 is secured to the bearing carrier 138 by bolts 140. Seals 142 are provided between the adapter 106 and the bearing retainer 136. The bearing carrier 138 is connected to the clutch housing 108 by bolts 144.

The clutch shaft 128 includes an intermediate externally splined portion 146 that meshes with the internal splines of a clutch hub 148 of the clutch assembly 126. The clutch hub 148 is connected in a conventional manner by clutch plates 150 to a clutch cup 152 that surrounds the clutch hub 148. The clutch shaft 128 includes an inner end portion 154. A busing 156 is positioned on the shaft end portion 154. Surrounding the bushing 156 and rotatable relative thereto is a helical gear 158. The helical gear 158 includes an externally splined end portion 160 that is drivingly connected to a clutch cup 152. The gear splined end portion 160 is spaced from the clutch hub 148 by a thrust washer 162. With this arrangement rotation is transmitted through clutch assembly 126 to the clutch cup 152 and therefrom to the helical gear 158. The helical gear 158 is rotatably supported within the gear case portion 114 by bearings 164.

The helical gear 158 transmits rotation of the clutch shaft 128 to a meshing helical gear 166 that is also positioned within gear case portion 114 and is nonrotatably connected to a splined end portion 168 of the input drive shaft 102. A nut 170 retains the helical gear 166 on the shaft splined end portion 168. The input drive shaft is rotatably supported within the gear case portion 114 by bearing 172 which is retained within the gear case 114 by bearing carrier 174. The bearing 172 is sealed by the cup within the gear case portion 114 by a seal ring 176.

As illustrated in FIG. 4 and as above discussed with respect to FIG. 3, the annular edge portions 80 and 82 of the intermediate drum section 74 and the edge portions 84 and 86 of the end drum sections 76 and 78 are spaced apart to form a pair of openings 178 and 180 between the intermediate drum section 74 and the respective end drum sections 76 and 78. The drum housing 50 is positioned between the openings 178 and 180. The annular housing portions 70 and 72 extend around the openings 178 and 180 respectively and rotatably support the intermediate drum section 74 and the end drum sections 76 and 78.

The drum housing 50 includes a bearing housing 182 that is connected by bolts 184 to the annular housing portion 72. The intermediate drum drive shaft 124 is rotatably supported within the bearing housing 182 by bearings 186 and 188. The intermediate drum section 74 which is nonrotatably connected to the end of the shaft 124 is not illustrated in FIG. 4. The end drum section 78 includes a bearing housing 120 which is connected by bolts 192 to the annular housing portion 72. With this arrangement the intermediate drum section 74 and the end drum sections 76 and 78 are rotatably supported on the end of the boom member 26.

In accordance with the present invention the input drive shaft 102 and the clutch shaft 128 are positioned at an angle and preferably an acute angle with respect to the longitudinal axis of the mining machine body portion 12. As above discussed the shafts 102 and 146 are drivingly connected by the meshing helical gears 158 and 166. Thus the gears 158 and 166 are arranged in parallel relation and both of the gears 158 and 166 are positioned at the same angle with respect to the longitudinal axis of the mining machine.

With this arrangement it is possible to provide a cutter drum with canted end drum sections 76 and 78 where sufficient space is provided in the respective end drum sections for mounting a planetary gear train thereby removing the drive gearing from the intermediate drum section 74. This permits a reduction in the diameter of the intermediate drum section 74 with the consequence of providing more clearance around the intermediate drum section 74 for the movement of dislodged material from the mine face rearwardly onto the mining machine gathering platform. By angling the input drive shaft 102 and the clutch shaft 128 with respect to the mining machine longitudinal axis, the shafts 102 and 128 are capable of being positioned perpendicular relative to the universal drive shaft 120 for the canted end drum section 78.

The input drive shaft 102 has a spiral bevel gear 194 secured thereto, and the spiral bevel gear 194 meshes with a spiral bevel 196. The spiral bevel 196 is rotatably supported within the end drum section 78 by bearings 198 and 200. The spiral bevel 194 on input shaft 102 is rotatably supported within the annular housing portion 72 by the bearing 202. The bearings 198 and 200 are positioned in surrounding relation with the shaft portion of spiral bevel gear 196 by the bearing housing 190. A bearing cap 204 is secured by bolts 206 to the end of a shaft portion 208 of spiral bevel gear 196.

The shaft portion 208 includes internal splines that mesh with external splines 210 of a sun gear 212 of the planetary gear train 104. Thus rotation of the input drive shaft 102 is transmitted by the spiral bevel gear 194 to the spiral bevel gear 196 and therefrom to the sun gear 212. Sun gear 212 includes an axial bore 214 through which the universal drive shaft 120 of the end drum section 78 extends. The sun gear 212 is rotatable on the universal drive shaft 120. The sun gear 212 includes an outer tubular portion 216 that meshes with a plurality of planet gears 218, one of which is shown in FIG. 4.

A planetary carrier assembly generally designated by the numeral 220 has a planet gear support shaft 222 for rotatably positioning the planet gear 218 in meshing relation with the splined outer tubular portion 216 of the sun gear 212. It should be understood that a planetary carrier assembly 220 is provided for each of the planet gears 218. The planet gears 218 mesh with the sun gear 212, and a ring gear 224 is secured to the bearing housing 190 by the bolts 192. Rotation of the sun gear 212 revolves the planetary gears 218 on the fixed ring gear 224. The planetary carrier assembly 220 rotates about the axis of the sun gear 212 which is concentric with the longitudinal axis of the end drum section 78.

The planetary gear support shaft 222 extends through a carrier 226 which includes an internally splined portion 228 that meshes with externally splined end portion 230 of the universal drive shaft 120 and externally splined portion 232 which meshes with an end drum drive shaft 118. The end of the sun gear 212 is spaced from the externally splined end portion 230 of the universal drive shaft 120 by a thrust washer 234. The end drum drive shaft 118 is rotatably supported within a bearing housing 236 by bearings 238 and 240 which are, in turn, maintained in surrounding relationship with the end drum drive shaft 118 by the bearing housing 236. A bearing cap 242 which is secured to one end of the end drum drive shaft 118 by bolts 244 also supports bearings 238.

The bearings 238 and 240 are sealed by seal rings 246 which are positioned between the adjacent ends of the end drum shaft 118 and the bearing housing 236. The end drum section 78 includes an outer cylindrical cup-shaped housing which is not shown in FIG. 4. The housing includes a side wall which surrounds the bearing housing 190, the ring gear 224, and the end drum drive shaft 118. The cutting elements are secured to the side wall of the cylindrical housing. The cylindrical housing also includes an end wall which is adapted for connection to the end drum drive shaft 118 by bolts extending into threaded bolt holes 248 that are provided in the outer face of the end drum drive shaft 118.

With this arrangement rotation is transmitted from the sun gear 212 to the planet gears 218 and therefrom to the planet carrier 226. In view of the fact that the planet carrier is nonrotatably connected to both the end drum drive shaft 118 and the universal drive shaft 120, rotation is transmitted from the planetary carrier 226 to the end drum drive shaft 118 and also to the universal drive shaft 120. Rotation of the end drum drive shaft 118 rotates the end drum section 78. The universal drive shaft 120 includes a second externally splined portion 250 which meshes with an arcuate geared portion 252 of a ring member 254 forming the universal joint assembly 122. The ring member 254 is secured by bolts 256 to a flanged end portion 258 of shaft 124. The ring member 254 with the arcuate geared portion 252 and the flanged end portion 258 on shaft 124 provide a universal drive connection, such as a ball-type Rezeppa joint, between the shaft 120 and the shaft 124.

The flanged end portion 258 includes a gear portion 260 which meshes with the ring gear 254. Thus with this arrangement rotation of the universal drive shaft 120 extending from the end drum section 78 is transmitted by the universal joint assembly 122 to the intermediate drum drive shaft 124 that extends into the intermediate drum section 74.

As illustrated in FIG. 4 the intermediate drum drive shaft 124 includes the flanged end portion 258 which is drivingly connected to the universal joint assembly 122, as above described, and a second end portion 262 that includes a plurality of planar faces 264 which are adaptable for connection to the intermediate drum section 74. The shaft 124 also includes a threaded portion 266. An adjusting nut 268 is threadedly connected to the threaded portion 266 and includes an opening 270 to receive a set screw to thereby securely retain the adjusting nut 268 on the shaft threaded portion 266. Seal rings 272 are provided between the adjusting nut 268 and the bearing housing 182 to seal the bearings 186 and 188 that rotatably support the shaft 124 within the bearing housing 182. With this arrangement rotation is transmitted from the respective end drum sections 76 and 78 to the intermediate drum section 74 by rotation transmitted by the universal drive shaft 120 through the universal joint assembly 122 to the intermediate drum drive shaft 124.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A continuous mining machine comprising, a body portion having a longitudinal axis, propelling means supporting said body portion for advancing said body portion, a boom member pivotally secured to said body portion and extending forwardly therefrom, a drum member rotatably mounted on the front of said boom member transversely to said body portion, said drum member having cutting elements extending therefrom, said cutting elements being arranged on said drum member to provide a continuous cutting pattern along the length of said drum member, said drum member having an intermediate drum section and a pair of canted end drum sections, said pair of canted end drum sections extending angularly from the ends of said intermediate drum section respectively, said pair of canted end drum sections being spaced from said intermediate drum section to form a pair of openings between said intermediate drum section and said respective canted end drum sections, power means mounted on said body portion for rotating said drum member, drive means for transmitting rotation from said power means to said drum member, said drive means including input drive shaft means for transmitting rotation to said canted end drum sections, said input drive shaft means extending from said power means angularly relative to said body portion longitudinal axis through said pair of openings, output drive means drivingly connected to said input drive shaft means for transmitting rotation from said canted end drum sections to said intermediate drum section, said input drive shaft means including a first input shaft and a second input shaft, said first and second input shafts each including a first end portion and a second end portion, said first input shaft first end portion being drivingly connected to said power means, said second input shaft first end portion being drivingly connected to a respective one of said canted end drum sections, said first and second input shaft second end portions being drivingly connected to each other, a helical gear nonrotatably connected to said second end portion of each of said first and second input shafts, and said helical gear of said first input shaft meshing with said helical gear of said second input shaft.

2. A continuous mining machine as set forth in claim 1 which includes, said input drive shaft means being positioned at an acute angle with respect to said body portion longitudinal axis, said output drive means being rotatably supported within each of said canted end drum sections, and means for drivingly connecting said input drive shaft means to said canted end drum sections so that said input drive shaft means is positioned perpendicular to the axis of rotation of said output drive means.

3. A continuous mining machine as set forth in claim 1 in which, said first and second input shafts each having opposite end portions, said first and second input shafts being positioned in parallel relationship to each other and drivingly connected to each other for transmitting rotation from said power means to a respective one of said canted end drum sections, and said first and second input shafts being positioned at an acute angle with respect to said longitudinal axis of said body portion.

4. A continuous mining machine as set forth in claim 1 which includes.

said input drive shaft means being positioned at an acute angle with respect to said body portion longitudinal axis, said first and second input shafts being positioned in parallel relationship to each other, said first input shaft being drivingly connected at one end to said power means, said second input shaft being drivingly connected at one end to a respective one of said canted end drum sections, and said first and second input shafts having adjacently positioned end portions drivingly connected such that rotation is transmitted from said power means by said first and second input shafts to said respective canted end drum section.

5. A continuous mining machine as set forth in claim 1 which includes, a spiral bevel gear nonrotatably connected to said first end portion of said second input shaft within said respective canted end drum section, said output drive means being positioned within said respective canted end drum section and being drivingly connected thereto, and said output drive means including a spiral bevel gear meshing with said spiral bevel gear of said second input shaft to transmit rotation from said second input shaft to said output drive means to rotate said respective canted end drum section.

6. A continuous mining machine as set forth in claim 1 which includes, said output drive means being positioned within said respective canted end drum section, said output drive means including a planetary gear train arranged in meshing relation with said input drive shaft means, an end drum drive shaft nonrotatably connected to said respective canted end drum section, and said end drum drive shaft arranged in meshing relation with planetary gear train to thereby transmit rotation from said input drive shaft means to said respective canted end drum section.

7. A continuous mining machine as set forth in claim 6 which includes, a universal drive shaft rotatably supported in said respective canted end drum section, said universal drive shaft having a first end portion nonrotatably connected to said planetary gear train and a second end portion, and means for drivingly connecting said universal drive shaft second end portion to said intermediate drum section to transmit rotation from said respective canted end drum section to said intermediate drum section.

8. A continuous mining machine comprising, a body portion having a longitudinal axis, propelling means supporting said body portion for advancing said body portion, a boom member pivotally secured to said body portion and extending forwardly therefrom, a drum member rotatably mounted on the front of said boom member transversely to said body portion, and said drum member having cutting elements extending therefrom, said cutting elements being arranged on said drum member to provide a continuous cutting pattern along the length of said drum member, said drum member having an intermediate drum section and a pair of canted end drum sections, said pair of canted end drum sections extending angularly from the ends of said intermediate drum section respectively, said pair of canted end drum sections being spaced from said intermediate drum section to form a pair of openings between said intermediate drum section and said respective canted end drum sections, power means mounted on said body portion for rotating said drum member, drive means for transmitting rotation from said power means to said drum member, said drive means including input drive shaft means for transmitting rotation to said canted end drum sections, said input drive shaft means extending from said power means angularly relative to said body portion longitudinal axis through said pair of openings, output drive means drivingly connected to said input drive shaft means for transmitting rotation from said canted end drum sections to said intermediate drum sections, said input drive shaft means including a first input shaft and a second input shaft, said first and second input shafts each including a first end portion and a second end portion, said first input shaft first end portion being drivingly connected to said power means, said second input shaft first end portion being drivingly connected to a respective one of said canted end drum sections, said first and second input shaft second end portions being drivingly connected to each other, a spiral bevel gear nonrotatably connected to said first end portion of said second input shaft within said respective canted end drum section, said output drive means being positioned within said respective canted end drum section and being drivingly connected thereto, and said output drive means including a spiral bevel gear meshing with said spiral bevel gear of said second input shaft to transmit rotation from said second input shaft to said output drive means to rotate said respective canted end drum section.

9. A continuous mining machine as set forth in claim 8 which includes, a helical gear nonrotatably connected to said second end portion of each of said first and second input shafts, and said helical gear of said first input shaft meshing with said helical gear of said second input shaft.

10. A continuous mining machine as set forth in claim 8 which includes, said input drive shaft means being positioned at an acute angle with respect to said body portion longitudinal axis, said output drive means being rotatably supported within each of said canted end drum sections, and means for drivingly connecting said input drive shaft means to said canted end drum sections so that said input drive shaft means is positioned perpendicular to the axis of rotation of said output drive means.

11. A continuous mining machine as set forth in claim 8 which includes, said first and second input shafts each having opposite end portions, said first and second input shafts being positioned in parallel relationship to each other and drivingly connected to each other for transmitting rotation from said power means to a respective one of said canted end drum sections, and said first and second input shafts being positioned at an acute angle with respect to said longitudinal axis of said body portion.

12. A continuous mining machine as set forth in claim 8 which includes, said input drive shaft means being positioned at an acute angle with respect to said body portion longitudinal axis, said first and second input shafts being positioned in parallel relationship to each other, said first input shaft being drivingly connected at one end to said power means, said second input shaft being drivingly connected at one end to a respective one of said canted end drum sections, and said first and second input shafts having adjacently positioned end portions drivingly connected such that rotation is transmitted from said power means by said first and second input shafts to said respective canted end drum section.

13. A continuous mining machine as set forth in claim 8 which includes, said output drive means being positioned within said respective canted end drum section, said output drive means including a planetary gear train arranged in meshing relation with said input drive shaft means, an end drum drive shaft nonrotatably connected to said respective canted end drum section, and said end drum drive shaft arranged in meshing relation with planetary gear train to thereby transmit rotation from said input drive shaft means to said respective canted end drum section.

14. A continuous mining machine as set forth in claim 13 which includes, a universal drive shaft rotatably supported in said respective canted end drum section, said universal drive shaft having a first end portion nonrotatably connected to said planetary gear train and a second end portion, and means for drivingly connecting said universal drive shaft second end portion to said intermediate drum section to transmit rotation from said respective canted end drum section to said intermediate drum section.

15. A continuous mining machine comprising, a body portion having a longitudinal axis, propelling means supporting said body portion for advancing said body portion, a boom member pivotally secured to said body portion and extending forwardly therefrom, a drum member rotatably mounted on the front of said boom member transversely to said body portion, said drum member having cutting elements extending therefrom, said cutting elements being arranged on said drum member to provide a continuous cutting pattern along the length of said drum member, said drum member having an intermediate drum section and a pair of canted end drum sections, said pair of canted end drum sections extending angularly from the ends of said intermediate drum section respectively, said pair of canted end drum sections being spaced from said intermediate drum section to form a pair of openings between said intermediate drum section and said respective canted end drum sections, power means mounted on said body portion for rotating said drum member, drive means for transmitting rotation from said power means to said drum member, said drive means including input drive shaft means for transmitting rotation to said canted end drum sections, said input drive shaft means extending from said power means angularly relative to said body portion longitudinal axis through said pair of openings, output drive means drivingly connected to said input drive shaft means for transmitting rotation from said canted end drum sections to said intermediate drum section, said output drive means being positioned within said respective canted end drum section, said output drive means including a planetary gear train arranged in meshing relation with said input drive shaft means, an end drum drive shaft nonrotatably connected to said respective canted end drum section, and said end drum drive shaft arranged in meshing relation with planetary gear train to thereby transmit rotation from said input drive shaft means to said respective canted end drum section.

16. A continuous mining machine as set forth in claim 15 which includes, said input drive shaft means being positioned at an acute angle with respect to said body portion longitudinal axis, said output drive means being rotatably supported within each of said canted end drum sections, and means for drivingly connecting said input drive shaft means to said canted end drum sections so that said input drive shaft means is positioned perpendicular to the axis of rotation of said output drive means.

17. A continuous mining machine as set forth in claim 15 in which, said input drive shaft means includes a first input shaft and a second input shaft, said first and second input shafts each having opposite end portions, said first and second input shafts being positioned in parallel relationship to each other and drivingly connected to each other for transmitting rotation from said power means to a respective one of said canted end drum sections, and said first and second input shafts being positioned at an acute angle with respect to said longitudinal axis of said body portion.

18. A continuous mining machine as set forth in claim 15 which includes, said input drive shaft means being positioned at an acute angle with respect to said body portion longitudinal axis, said input drive shaft means including a first input shaft and a second input shaft, said first and second input shafts being positioned in parallel relationship to each other, said first input shaft being drivingly connected at one end to said power means, said second input shaft being drivingly connected at one end to a respective one of said canted end drum sections, and said first and second input shafts having adjacently positioned end portions drivingly connected such that rotation is transmitted from said power means by said first and second input shafts to said respective canted end drum section.

19. A continuous mining machine as set forth in claim 15 in which, said input drive shaft means includes a first input shaft and a second input shaft, said first and second input shafts each including a first end portion and a second end portion, said first input shaft first end portion being drivingly connected to said power means, said second input shaft first end portion being drivingly connected to a respective one of said canted end drum sections, and said first and second input shaft second end portions being drivingly connected to each other.

20. A continuous mining machine as set forth in claim 19 which includes, a helical gear nonrotatably connected to said second end portion of each of said first and second input shafts, and said helical gear of said first input shaft meshing with said helical gear of said second input shaft.

21. A continuous mining machine as set forth in claim 19 which includes, a spiral bevel gear nonrotatably connected to said first end portion of said second input shaft within said respective canted end drum section, said output drive means being positioned within said respective canted end drum section and being drivingly connected thereto, and said output drive means including a spiral bevel gear meshing with said spiral bevel gear of said second input shaft to transmit rotation from said second input shaft to said output drive means to rotate said respective canted end drum section.

22. A continuous mining machine as set forth in claim 15 which includes, a universal drive shaft rotatably supported in said respective canted end drum section, said universal drive shaft having a first end portion nonrotatably connected to said planetary gear train and a second end portion, and means for drivingly connecting said universal drive shaft second end portion to said intermediate drum section to transmit rotation from said respective canted end drum section to said intermediate drum section.

* * * * *